US008604799B2

(12) United States Patent
Rödel et al.

(10) Patent No.: US 8,604,799 B2
(45) Date of Patent: Dec. 10, 2013

(54) METHOD AND DEVICE FOR CHECKING THE SEAL OF STRUCTURAL SEALS

(75) Inventors: Andreas Rödel, Kleinmachnow (DE); Norbert Komma, Vienna (AT)

(73) Assignee: Progeo Monitoring GmbH, Grossbeeren (DE)

( * ) Notice: Subject to any disclaimer, the term of this patent is extended or adjusted under 35 U.S.C. 154(b) by 420 days.

(21) Appl. No.: 13/054,852

(22) PCT Filed: Jul. 20, 2009

(86) PCT No.: PCT/EP2009/059322

§ 371 (c)(1),
(2), (4) Date: Apr. 19, 2011

(87) PCT Pub. No.: WO2010/010072

PCT Pub. Date: Jan. 28, 2010

(65) Prior Publication Data

US 2011/0187394 A1 Aug. 4, 2011

(30) Foreign Application Priority Data

Jul. 19, 2008 (DE) ..... 10 2008 033 947

(51) Int. Cl.

| | |
|---|---|
| ***G01R 31/12*** | (2006.01) |
| ***G01R 31/08*** | (2006.01) |
| ***H01H 9/50*** | (2006.01) |

(52) U.S. Cl.

USPC ..... 324/536; 324/527; 324/530

(58) Field of Classification Search

USPC ..... 324/536, 527, 530

See application file for complete search history.

(56) References Cited

U.S. PATENT DOCUMENTS

| | | | | |
|---|---|---|---|---|
| 4,302,725 | A * | 11/1981 | Nubani | 324/404 |
| 5,362,182 | A | 11/1994 | Hergenrother | |
| 6,004,070 | A | 12/1999 | Van Camp | |
| 6,583,627 | B2 * | 6/2003 | Henning et al. | 324/464 |
| 6,648,552 | B1 | 11/2003 | Smith et al. | |

FOREIGN PATENT DOCUMENTS

| | | |
|---|---|---|
| DE | 4125430 A1 | 2/1993 |
| EP | 0525278 A2 | 2/1993 |
| EP | 1659224 A1 | 5/2006 |
| WO | 0001895 A1 | 1/2000 |

* cited by examiner

*Primary Examiner* — Amy He

(74) *Attorney, Agent, or Firm* — The Webb Law Firm

(57) ABSTRACT

A method for determining damaged faulty and/or weak points in a structural seal. The seal is provided with an electrically conductive layer arranged inside or outside the structural seal and extends over substantially the entire surface of the structural seal and to which layer an electrical test voltage is applied. To establish the damaged, faulty and/or weak points, a further electrically conductive layer is used, which is electrically separated from the aforementioned electrically conductive layer by the structural seal and extends over substantially the entire surface of the structural seal. The level of the test voltage between the electrically conductive layers charged with voltage is selected such that when at least one electrically non-conductive damaged, faulty and/or weak point is present in the structural seal, the electrical disruptive strength is exceeded and an electric spark or arc is formed at the location of the damaged, faulty and/or weak point.

20 Claims, 2 Drawing Sheets

METHOD AND DEVICE FOR CHECKING THE SEAL OF STRUCTURAL SEALS

BACKGROUND OF THE INVENTION

1. Field of the Invention

The present invention relates to a method and device for checking the tightness of structural seals. The invention relates in particular to a method for detecting damaged or faulty points, in particular weak points having a reduced material thickness in a membrane-type, electrically non-conductive or only poorly conductive structural seal which has a high electrical disruptive strength by comparison with air and is provided with an electrically conductive layer which is arranged inside or outside the structural seal and extends over substantially the entire surface of the structural seal and to which an electrical test voltage is applied, and to a membrane-type structural seal, which is made of electrically non-conductive or only poorly conductive material and has a high electrical disruptive strength by comparison with air, comprising a test device having an electrical voltage source for detecting damaged or faulty points, in particular weak points having a reduced material thickness in the structural seal, and comprising an electrically conductive layer which is arranged inside or outside the structural seal and extends over substantially the entire surface of the structural seal.

2. Description of Related Art

Thus far, membrane-type seals have represented a considerable proportion of structural seals. The purpose of structural seals is to protect the building reliably against the penetration of groundwater, earth moisture and rain water and thus to prevent damage to the basic structure and limitations on the use of the building over the entire life of the building. Membrane-type seals generally consist of bituminous masses or of the mass plastics materials which are available nowadays, and industrially are produced generally as web-type products but also increasingly as sealing masses to be applied to surfaces on the building site. To carry out their function, membrane-type seals have to be water-tight.

Product defects, faulty processing, inappropriate loads and the effect of weathering can lead to a loss of tightness in membrane-type structural seals, and this can cause extensive further damage to the building if the damage is not identified soon enough in order to be eliminated immediately in a targeted manner. Thus, the majority of damage to buildings thus far has been caused by damage to the structural seals. Further, systematic damage elimination is often impossible even if the seal is known to be damaged, since the damaged point cannot be located and is often inaccessibly embedded in the structure of the building. Damage to membrane-type structural seals thus involves considerable damage potential.

Against this background, there have already been attempts for many years to provide options for monitoring tightness and locating leaks in structural seals, with the aim of recognising damage to seals as soon as possible and locating this damage as precisely as possible. The presently available solutions are characterised by the following properties:

Systems of a simple, conventional type: in these systems, the seal is constructed in such a way that on the side of the seal intended to be dry, a visual checking option is provided in such a way that penetrating leaked water can be identified in the course of an inspection. By adding electrical moisture detectors, the monitoring can also be automated. A disadvantage of this construction is that it is virtually impossible to locate leaks, and leaked water also cannot be distinguished from the appearance of condensation water, in such a way that decisive leak identification is not possible in practice. A further disadvantage is that a check on the seal is always dependent on the seal being loaded or already having been loaded with water at the time of the test.

Vacuum systems: in these systems, the seal is constructed with two layers in such a way that there is an exhaustible intermediate space between the seal layers. If the control space is evacuated to a particular negative pressure, the tightness of the seal can be determined based on the increase in pressure over time. An advantage of this system is that the tightness of the seal can also be determined independently of water-loading. Disadvantages of the method are the high costs of the double seal system and the lack of an option for locating the damaged point in a targeted manner in the case of a leak.

Electro-resistive systems: these systems exploit the fact that, in terms of the material thereof, membrane-type seals have a high electrical resistivity and a high disruptive strength. Various configurations are available:

In potentiometric methods, the electric potential field which arises when an electrical voltage is applied between the wet seal exterior or the contact layer, or the building structure if there is no contact layer, is determined on the wet exterior of the seal or in an electrical contact layer on the side intended to be dry underneath the seal by passing an electric current through the leak point. These methods can be very effective, depending on the technical implementation, and in some cases make fully automatic tightness monitoring and precise location of leak points possible.

Patent DE 41 25 430 C2 discloses a sealing film having an internal conductive layer which is covered with an electrically non-conductive layer on each of the two sides. If there is a leak in this seal, the occurrence of the leak can be identified by measuring the current flowing from the conductive layer towards the earth or towards the conductive support medium.

A disadvantage of these methods is that leak identification is basically only possible when the seal is loaded with water or wet covering material and a conductive path has formed at the leak point by way of penetrating moisture. If the measurement is carried out from the upper seal surface, the entire seal surface must be examined manually with the test device in order to check the seal. This requires a considerable amount of time and only produces reliable results with sufficient specialist knowledge.

This disadvantage is overcome in high-voltage test methods by using a movable test electrode, known as a spark brush, to apply to the uncovered side of the seal, facing away from the building, a high voltage, the counter pole of which is either the earthed building structure on which the seal is laid or an additional conductive layer on the side facing the building immediately below or behind the seal, the layer either lying loosely below or behind the seal or being firmly connected to the seal as disclosed in patent application WO 00/01895 A1. If the test electrode is then guided over a damaged point in the seal, the disruptive strength there is reduced by comparison with the intact seal surface, either because the material thickness is lower than in an intact seal as a result of the damage or because there is merely an air gap which has a considerably lower disruptive strength than the seal material. As a result of these conditions, a spark is ignited upon passing over a damaged point. This is detected by the device and a leak is thus reliably identified. So as to be able to work only with relatively low test voltages, in some available systems the test is carried out with a water spraying device instead of a spark brush, in such a way that the voltage is applied to the seal via the water jet, which then also penetrates into capillary-type damaged points and thus produces a conductive connection at the damaged point.

A disadvantage of known high-voltage test methods is that the seal must be completely uncovered, and if these methods are applied using water as a test medium, water can run off and produce an electrical connection via the edge of the seal, distorting the measurement result. Since the entire seal has to be examined with the test electrode for testing, the method is very time-consuming, in particular when large or poorly accessible seals are to be tested. If not the entire surface is brushed with the test electrode during testing, which cannot be systematically monitored, there is a risk of incorrect measurements. The known high-voltage tests are thus not suitable for testing building seals systematically during subsequent building work, since in this case it is often no longer possible to access the seal.

In particular in tunnel seals, seal damage is a very significant risk, since seal damage is generally first identified when water enters the finished tunnel, since the drainage must initially be ceased before the hydrostatic loading pressure on the seal is set and the seal is first loaded with water. The pressure build-up in this case results in a further risk of damage to the seal, since as the external pressure increases, the seal is pressed more and more strongly against the concrete inner shell. If regions of the inner shell are not completely filled with concrete, the seal is pressed against the uncovered reinforcement of the inner shell and perforated, in such a way that there are further risks of damage. The problem is aggravated by the fact that the water, as has been found by experience, does not exit the concrete inner shell in the place where the leak in the seal is actually located, but finds a path behind the concrete inner shell until it exits at leaky gaps in the joints between tunnel segments or through cracks in the concrete in the tunnel tubes.

Since the seal is concealed behind the tunnel inner shell in such a way that it cannot be inspected, and no information or only vague information as to the position of the leak is available, repairing leaks in tunnel seals has thus far required expensive injection processes over a large area, which in spite of the great expense are often unsuccessful, in such a way that a large number of tunnels remain leaky despite repairs and permanently generate considerably increased maintenance costs. Thus, in its annual report for 2004, the Swiss Federal Laboratories for Materials Testing and Research (EMPA) reported on the results of a joint research project with the Swiss Federal Roads Office (FEDRO), in which a total of 63 Swiss tunnels were tested for the effectiveness of the sealing systems thereof. Subsequently, even after repairs to the established leaks by injection processes, 13 tunnels were still classified as leaky, of which only 10 were tunnels containing compressed water. Against the background of these disappointing results and in view of the immense costs of the (often unsuccessful) repairs and maintenance of leaky tunnels, the report concluded with the urgent appeal to do everything possible to make tunnel seals tight from the start.

However, this aim can only be achieved if the quality of the seal, and thus in particular the tightness thereof, can be tested during construction and soon after the individual phases of constructing the building, damage can be established systematically via stable, objective measuring results, established damage can be located in a simple manner, and defects or weak points in the rest of the building work which can be lead to damage to the structural seal, such as incomplete concreting, are likewise systematically detected and eliminated by suitable processes before damage to the seal occurs as further damage.

SUMMARY OF THE INVENTION

The object of the present invention is to provide a method for checking the tightness of membrane-type, electrically non-conductive or only poorly conductive structural seals which makes it possible to check the tightness over the entire surface of seals of this type, irrespective of whether the seal lies on a support or is uncovered on the upper and/or lower side, is covered with a reinforcement or is entirely embedded inaccessibly in the building structure. The desired method is intended to make it possible to check the tightness even when the seal to be tested is not yet covered with a wet material or in contact with water. In particular, the desired method is intended to make it possible to localise or preferably locate any damaged points in the seal to be tested. The object of the invention is also to provide a membrane-type structural seal which is provided with a corresponding test device which makes it possible to carry out the desired method.

The method according to the invention serves to detect damaged or faulty points, in particular weak points having a reduced material thickness in a membrane-type, electrically non-conductive or only poorly conductive structural seal which has a high electrical disruptive strength in comparison to air. The structural seal is provided with a (first) electrically conductive layer, which is arranged inside or outside the structural seal and extends over substantially the entire surface of the structural seal. According to the invention, to detect the aforementioned damaged, faulty and/or weak points, a further electrically conductive layer is used, which is electrically separated from the aforementioned electrically conductive layer by the structural seal and also extends over substantially the entire surface of the structural seal. An electrical test voltage is applied to the two electrically conductive layers, the strength of said voltage being selected in such a way that if there is at least one electrically non-conductive damaged, faulty and/or weak point in the structural seal, this results in the electrical disruptive strength being exceeded and an electric spark or arc being formed at the location of the damaged, faulty and/or weak point, the test voltage being selected to be smaller than a destructive test voltage at which an electrical breakdown accompanied by the formation of an electric spark or arc would occur in an undamaged and/or un-weakened structural seal corresponding to the structural seal to be tested.

In the present context, the term "only poorly conductive" is taken to mean a seal or sealing material having an electrical resistivity greater than $10^{10}$ ohm cm.

The term "over substantially the entire surface" should be taken to mean that the relevant electrically conductive layer extends at least over the surface region of the structural seal or plastics material sealing web which is to be checked for tightness. For example, an edge region of the plastics material sealing web, for welding to an adjacent plastics material sealing web, may optionally also be formed without an electrically conductive layer. According to the invention, preferably at least 90% of the area of the planar structural seal or plastics material sealing web to be tested is entirely covered with the conductive layers.

The method according to the invention does not exhibit the disadvantages of the prior art test methods described at the outset. It makes is possible to check the tightness of membrane-type, electrically non-conductive or only poorly conductive structural seals over the entire surface thereof without the relevant seal having to be uncovered and without the seal having to be under the influence of moisture or water in the region to be tested. It is still possible to test the seal using the method according to the invention even with these constraints.

Further, the method according to the invention makes it possible to localise spatially any damaged points in the seal to be tested. By way of combination with permanently installed potentiometric methods, the seal can then further be monitored in a finished, water-loaded tunnel construction.

According to a preferred embodiment of the method according to the invention, the test voltage applied to the electrically conductive layers is selected to be at most 80% of an electrical voltage at which an electrical breakdown accompanied by the formation of an electric spark or arc would occur in an undamaged and/or un-weakened structural seal corresponding to the structural seal to be tested. In this way, weak points in the seal to be tested, caused by material erosion or reduction in layer thickness, are reliably detected, and meanwhile it is ensured that intact surface regions of the seal which have a required target thickness are not disrupted by the electrical voltage.

In a further embodiment of the method, instead of working with a fixed test voltage, the test voltage is increased continuously or incrementally and/or testing is carried out in a plurality of test intervals, the test voltage being increased in every successive test interval until the minimum test voltage corresponding to the intact seal is reached. Using the disruptive voltages which are actually reached in each case, it is then possible to distinguish between different damage profiles (for example reduction in material thickness or penetrating leaks). It may further be advantageous to maintain the test voltage for a particular length of time, since in particular for lesser damage, it may occasionally take some time before an ignition channel, via which a spark can then be discharged, forms at a damaged point under the influence of the test voltage and the resulting electric field.

In a further embodiment of the method, the seal to be tested is preferably subdivided into individual test portions, it being possible to achieve the subdivision in that one or even both of the conductive layers are segmented in such a way that it is possible to apply a voltage to individual test portions of the seal to be tested portion by portion, this expediently taking place in such a way that each sealing web segment also forms a test segment.

In a further embodiment of the method, to make possible a simple application, appropriate for building sites, of the test method according to the invention, the conductive layers required for surface testing and the seal to be tested are constructed as a preformed multilayer sandwich system made up of conductive layers and at least one electrically insulating sealing layer, the conductive layers being connected to the seal in part or over the entire surface in a suitable manner, for example by gluing, laminating, backing, coextrusion, vapour deposition or coating or combinations of these methods. In this case, the conductive layers preferably have a surface resistance of less than $10^6$ ohm and a resistivity of less than $10^5$ ohm cm.

A further advantageous embodiment of the method according to the invention consists in applying the test voltage to one of the electrically conductive layers via at least two mutually spatially separated supply points, measuring the current flows or corresponding electrical values, in particular the electrical voltage, during an electrical breakdown at a damaged, faulty and/or weak point, and determining the location of the damaged, faulty and/or weak point from the ratio of the currents or corresponding electrical values, in particular voltages. In this way, the location of a damaged, faulty and/or weak point in the seal can be determined relatively precisely, even if the seal to be tested is not accessible or only accessible in part.

In this case, the electrical voltage ratio is preferably measured using one or more measuring probes which are capacitively coupled to one of the conductive layers indirectly, without a galvanic connection. This makes it possible to couple the measuring probes in a simple and flexible manner. The measuring probes can thus be transposed in a simple manner, in such a way that the location of a damaged, faulty and/or weak point in the seal can optionally be determined and localised more rapidly. However, the electrical voltage ratio can also be measured using measuring probes which are coupled directly to one of the conductive layers.

A further embodiment of the method according to the invention provides that an electrically conductive abutment layer of the structural seal, for example a damp foundation, in particular a concrete layer which is still relatively damp or hardened, is used as one of the electrically conductive layers. In this case, a second or additional electrically conductive layer is not produced, and an already present electrically conductive abutment layer is used instead, making a corresponding saving in costs possible. For example, for a flat roof, the relatively smooth concrete surface can be used as an electrically conductive abutment layer.

A further advantageous embodiment of the method according to the invention is characterised in that at least the electrically conductive layer arranged on the accessible side of the structural seal is provided with an electrically non-conductive layer, preferably a light-coloured, electrically insulating plastics material film. This electrically non-conductive layer protects against electric shocks. A light-coloured configuration of this layer has a favourable effect on the visual conditions for persons working inside or in the region of the structural seal and further serves for visual detection of mechanical damages.

For as simple and rapid an application as possible of a conventional structural seal, it is advantageous for the structural seal to be industrially preformed together with the electrically conductive layers and the electrically insulating layer (plastics material film) as a sandwich-type composite film or composite sealing web, for example by coextrusion or backing. In particular if the various layers are coextruded, this may sometimes result in faulty points in the intermediate or embedded electrically conductive layer, which can prevent reliable detection of faulty, damaged and/or weak points in the structural seal which is later to be tested. To detect any weak points in the possibly invisible electrically conductive layer, a further embodiment of the method according to the invention provides that it is tested using electrical capacitance measurement whether the electrically conductive layer arranged at least on the accessible side of the structural seal is formed over the entire surface and/or whether the electrically conductive layer arranged on the rear side of the structural seal is formed over the entire surface.

The membrane-type structural seal according to the invention consists of electrically non-conductive material, in such a way that it has a high electrical disruptive strength by comparison with air. It is provided with a test device, having an electrical voltage source, for detecting damaged or faulty points, in particular weak points having a reduced material thickness, in the structural seal. Further, the structural seal according to the invention is provided with a (first) electrically conductive layer, which is arranged inside or outside the structural seal and extends over substantially the entire surface of the structural seal. According to the invention, the structural seal is provided with a further electrically conductive layer, which is electrically separated from the aforementioned (first) electrically conductive layer by the structural seal and extends over substantially the entire surface of the structural seal. The test device comprises means for adjusting the level of the test voltage which can be applied to the structural seal via the electrically conductive layers, in such a way that the test voltage can be increased continuously or in steps from zero or a minimum value greater than zero to an electrical voltage level which is reduced by a precautionary amount below a disruptive voltage at which an electrical breakdown accompanied by the formation of an electric spark or arc would occur in an undamaged and/or unweakened structural seal corresponding to the structural seal to be tested, and is higher by a precautionary amount than that of the disruptive strength of an air path corresponding to the thickness of the structural seal.

BRIEF DESCRIPTION OF THE DRAWINGS

Further preferred and advantageous embodiments of the structural seal according to the invention are given in the dependent claims and the following description. In the following, the invention is explained in greater detail with reference to drawings showing several embodiments, in which:

DETAILED DESCRIPTION OF THE PRESENT INVENTION

Figure 1:
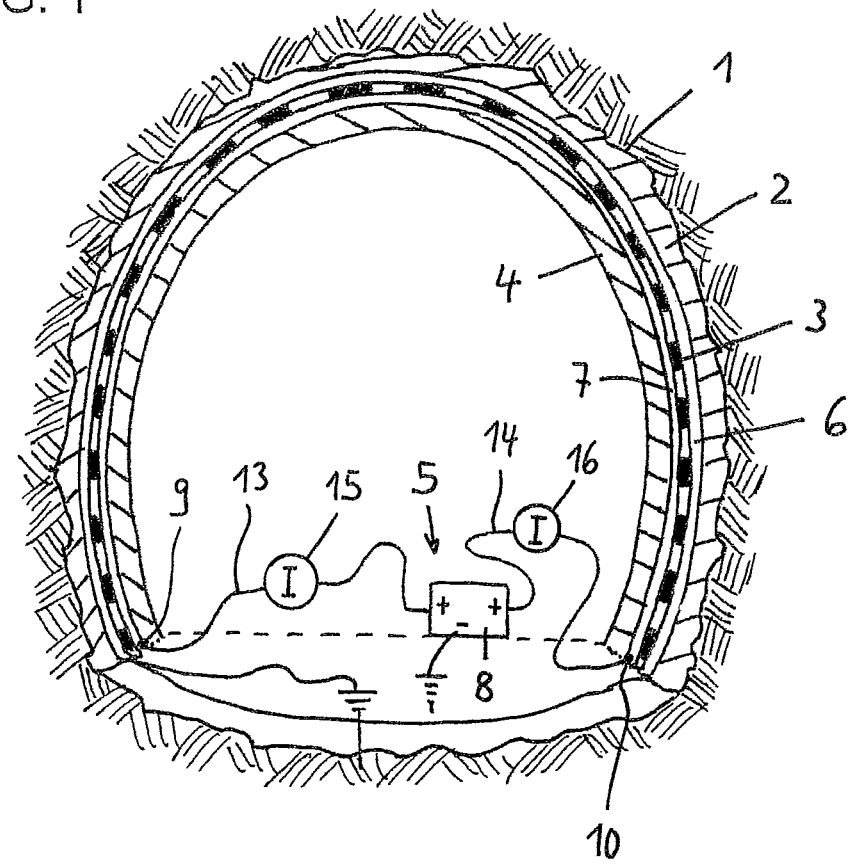
FIG. 1 is a cross-section of a tunnel comprising a structural seal according to the invention.

The roof arch of the tunnel shown in FIG. 1 was covered with sprayed concrete 2 and steel reinforcements immediately after completion of the excavation 1. A tunnel of this type is conventionally advanced discontinuously in axial subportions. The reinforced sprayed concrete 2 forms an outer roof arch, the inner surface of which is covered with a structural seal 3. The structural seal 3 is intended to prevent penetration of water and moisture from the rock in the region of the outer roof arch 2. The structural seal 3 is followed internally by an inner roof arch 4 made of concrete, referred to hereinafter as an inner shell. Before the inner roof arch or inner shell 4 is concreted, the structural seal 3 is checked for tightness. For this purpose, the structural seal 3 is provided with a test device 5 for detecting any possibly existing damaged or faulty points.

The structural seal 3 to be tested is a seal having a material-conditioned high insulating resistance and a high disruptive strength by comparison with air. Via two electrically conductive layers 6, 7, which according to the invention are arranged lying against the two outer surfaces of the seal 3 to be tested, or arranged with one conductive layer 6 or 7 lying against an outer surface of the seal 3 and one conductive layer 7 or 6 being located inside the seal 3 to be tested, or arranged with both conductive layers 6, 7 located inside the seal 3 to be tested, in such a way that the conductive layers 6, 7 are always mutually electrically separated constructionally by a layer of non-conductive sealing material, namely the seal 3 or sealing web to be tested, a test voltage, potentially connected to or potentially free from the earth, is applied to the sealing surface to be tested using a suitable voltage source 8, in such a way that at every point between the two conductive layers 6, 7 an electric field is generated perpendicular to the planar seal (sealing web) 3 to be tested. Depending on the voltage source 8 used, this may be a constant and/or alternating electric field. To check the planar seal 3 for damage, according to the invention, the test voltage between the conductive layers 6, 7 charged with voltage is then selected in such a way that the disruptive strength is not exceeded at any point in the seal 3 for an intact sealing web 3, but is exceeded at points at which damage has reduced the material thickness of the sealing web 3 charged with voltage by comparison with the undamaged state, and/or where there are faulty points due to damage or manufacture in the seal 3, for which purpose it is expedient to use a test voltage of at least 1000 volts per millimeter thickness of the planar seal or sealing web 3 to be tested, with the result that a voltage breakdown occurs at these points, which can be detected and located in various ways according to the invention. In this way it is possible to check the tightness of the structural seal 3 or respective sealing web integrally over the entire surface thereof and determine damage to the seal 3 without water or moisture or a direct short circuit having to be present at the damage point, although it is still possible to detect damage to the seal 3 reliably using the method under these conditions. Thus, the method according to the invention achieves a considerably improved state of development by comparison with the prior art, making it possible to carry out reliable quality testing of seals 3 and to determine and locate damage to the seals in a simple and reliable manner, independently of the installation position of the seal 3, in the extreme case even with a seal 3 which hangs freely, and without water or moisture being required for the application of the test method.

According to the invention, for performing the method the level of the voltage applied via the conductive layers 6, 7 to the planar seal 3 to be tested as well as the flow of current from the voltage source 8 into the test arrangement can be measured during the test process. If there are damaged and/or faulty points in the planar seal 3, according to the invention the disruptive strength is exceeded at these damaged and/or faulty points, unless damage at these points has caused a direct short circuit between the conductive layers 6, 7, and thus there is an electrical breakdown through the planar seal 3 to be tested, resulting in a sudden discharge current flowing between the two conductive layers 6, 7 via the arc. This means that the test voltage at the seal 3 to be tested decreases and the charging current increases, which can be detected according to the invention from the measured progression of the measurement values of test voltage and charging current. If there are damages which result in a short circuit, having a low resistance by comparison with that of the intact sealing material, in the conductive layers 6, 7, this is detected based on the fact that a considerably higher short-circuit current flows than for an undamaged seal, even at a low test voltage which is not yet sufficient for a spark discharge. Thus, a short-circuit-based damage profile can also be established reliably using the method according to the invention. By contrast, if a predetermined test voltage is reached without a short-circuit current or arc discharge current occurring, the seal 3 is to be classified as intact, in particular if the maximum test voltage has already been applied over a long period without any further discharge effects. The electrical resistance of the test object is preferably determined from the quotient of the voltage and current and used as a further quality criterion.

According to the invention, the point of the ignition spark or a short circuit and thus the spatial location of the damaged point can be assigned in space if the test voltage is supplied via at least two sufficiently mutually spatially separated supply points 9, 10 (cf. FIG. 1), which in the case of test portions of elongate form preferably lie at the two opposite narrow ends of the test portion, and the flows of current or corresponding electrical values, for example the electrical voltage at the moment of the electrical breakdown, i.e. during the flow of the arc current or of the short-circuit current in the case of a short circuit, are measured at each supply line, in such a way that the location of the spark or short circuit, and thus the location of the damaged point, can be determined to a good approximation from the ratio of the flows of current or corresponding voltages, since this ratio broadly corresponds to the ratio of the distances of the supply points from the location of the spark or short circuit. In the case of a short circuit due to damage or a spark discharge due to damage, the voltage ratios can also be measured directly, in one of the two conductive layers 6, 7, or alternatively indirectly, without a galvanic connection to the electrical measurement circuit, by one or more capacitively coupled probes, for example from the visible side of the seal 3.

Alternatively or additionally, the appearance of ignition sparks or electric arcs can also be detected according to the invention by detecting the electromagnetic interference signals (known as bursts) proceeding from the ignition spark or electric arc using a suitable detector (not shown) and/or by detecting and evaluating the light and/or thermal radiation and/or material heating effects proceeding from the electric arc at the damaged point in a suitable manner, for example by suitable image display methods, and this also insofar that the detected interference signals and/or light and/or thermal radiation and/or material heating effects can also be used to locate the spark and/or short circuit location and thus the position of the damage. For example, a camera (not shown), in particular a thermal imaging camera, can be used for this purpose.

However, in the simplest case the spark path is located according to the invention purely visually, either by detecting and locating the electric arc while it is present or by detecting and locating the damage point by way of the changes caused to the visible side of the seal 3 by spark erosion and/or the effect of heat, during the sparking or after the sparking or short-circuit current has broken down. For this purpose, it can be advantageous to maintain the sparking at the damaged point or the short circuit until there is a clearly recognisable thermal effect at the damaged point.

In a further embodiment of the invention, at least one of the conductive layers 6, 7 is in the form of a conductive non-woven, woven or knitted fabric or another planar formation, the necessary conductivity being achieved by adding electrically conductive particles and/or fibres and/or yarns and/or wires to the inherently non-conductive non-woven, woven or knitted fabric or planar formation, and/or by coating or impregnating the inherently non-conductive non-woven, woven or knitted fabric or planar formation with appropriate conductive substances, and/or by vapour-depositing metal on the inherently non-conductive non-woven, woven or knitted fabric or planar formation, and/or a non-woven, woven or knitted fabric or other planar formation is used which exhibits the necessary conductivity for carrying out the test method by virtue of the use of electrically conductive fibres and/or yarns.

In a further embodiment of the method according to the invention or the device according to the invention, the electrical conductivity of the non-woven material or other planar formation is achieved in that a highly hygroscopic substance is applied to the substrate material of the non-woven material or planar formation or worked into the substrate material, in such a way that above a particular air humidity, the substance dissociates at least in part in the moisture taken up hygroscopically and induces an ionogenic electrical conductivity, sufficient for carrying out the method according to the invention, in the non-woven material or planar formation. In this case, the hygroscopic substance is preferably applied in the aqueous phase.

In a further embodiment of the test device or arrangement according to the invention, the microstructure of the surface, facing towards the seal 3 to be tested, of the non-woven material or other planar formation is produced in such a way that electrically conductive fibres, particles, yarns and/or wires project out of the surface, in such a way that, when the test voltage is applied between the conductive layers 6, 7, high field strength peaks occur in the portions projecting in this manner, with the result that the ignition of electric arcs is promoted under the appropriate damage conditions.

In a further embodiment of the structural seal or test arrangement according to the invention, the substrate material of the non-woven material or planar formation 6, 7 consists of components which are considerably more heat-resistant than thermoplastic polymers, preferably glass fibres, metal fibres and/or carbon fibres and/or more highly heat-resistant conductive particles, fibres and/or yarns, so as to prevent the surface of the non-woven material or the planar formation 6, 7 from melting prematurely in the region of the electric arc and adhering or burning away or evaporating as a result of the heat developed during the electrical arcing. This prevents the arc from being extinguished prematurely, and also from not being able to be ignited again at this point, without the thermally induced visible material change required for visual detection or sufficient material heating for thermographic detection being produced at the damaged point.

In a further embodiment of the method according to the invention, one or even both of the conductive layers which delimit the seal 3 to be tested are part of the building construction, for example the abutment of the seal 3 (for example the outer roof arch 2 in FIG. 1) and/or a constructional cover of the seal 3, and have a considerably higher electrical conductivity, sufficient for carrying out the test method, than the sealing material, in such a way that the use of one or even both of the conductive layers 6, 7 integrated in a sandwich-type manner into the seal 3 can be dispensed with for carrying out the test method.

Figure 2:
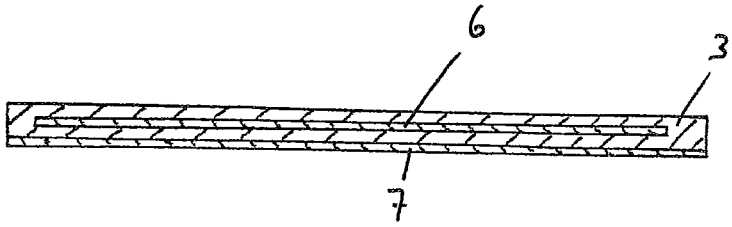
FIGS. 2 to 6 each show a section of various structural seals according to the invention in an enlarged cross-sectional view.
Figure 3:
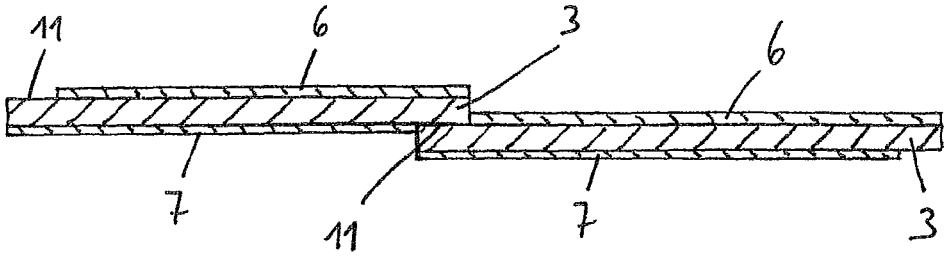

In a further embodiment of the structural seal or test arrangement according to the invention, at least one of the conductive layers 6, 7 is not guided up to the edge of the seal 3, but only far enough for the length and thus the disruptive strength of the air gap between the two layers charged with test voltage to be greater than the test voltage used for tightness testing (cf. FIGS. 2 and 3).

In a further embodiment of the structural seal or test arrangement according to the invention, at least one of the conductive layers 6, 7 is arranged inside the sealing web 3, this internal conductive layer 6 being smaller overall than the sealing web 3, in such a way that the conductive layer 6 is completely enclosed by electrically insulating sealing material at the longitudinal sides of the web and a sufficiently high disruptive strength is achieved at the longitudinal edges of the sealing web by comparison with the second conductive layer 7 for carrying out the test method (cf. FIG. 2).

In a further embodiment of the structural seal or test arrangement according to the invention, the conductive layer 6, which is arranged on the rock side or on the seal underside after the seal or sealing web 3 is laid, is in the form of a conductive non-woven fabric, the conductive non-woven fabric being guided on a longitudinal side of the sealing web 3 in a largely flush manner up to the edge of the seal 3, but being set back from the edge of the web in the width of the welding zone 11 on the other longitudinal side of the sealing web 3 to be tested, in such a way that the non-woven fabric need not be removed from the welding zone in an expensive manner before welding to the adjacent sealing web 3 (cf. FIG. 3).

Figure 4:
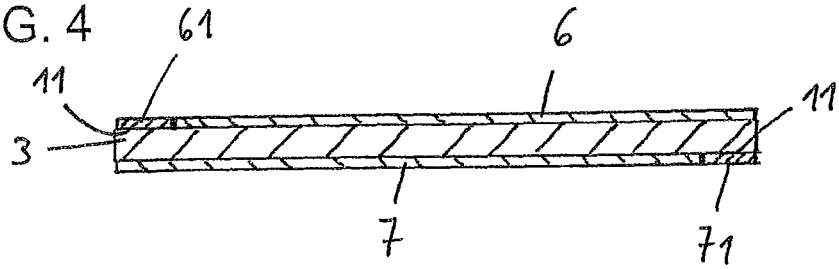

In a further embodiment of the structural seal or test arrangement according to the invention, this freely positioned welding edge 11, which is not covered with electrically conductive non-woven fabric 6, 7, of the sealing web 3 is provided with an easily removable electrical layer 61, 71 which is electrically connected to the conductive non-woven fabric 6, 7 in a suitable manner (cf. FIGS. 3 and 4). This provides that the sealing web 3 to be tested can be tested over the entire width thereof using the method according to the invention before being welded to an adjacent sealing web 3, without the conductive layer 6, 7 having to be removed from the welding zone 11 in an expensive manner after testing and before welding. The conductive layer 61, 71 arranged in the region 11 of what is later to be the welding zone may thus advantageously consist of an electrically conductive self-adhesive film or an electrically conductive self-adhesive non-woven fabric or an electrically conductive wipeable or washable coating.

Figure 5:
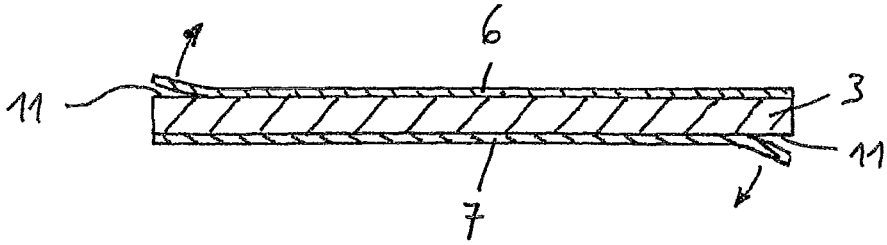
Figure 6:
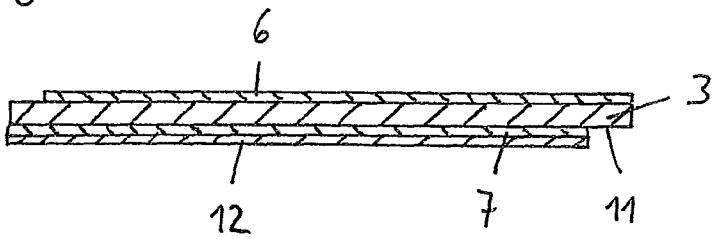

In a further embodiment of the structural seal or test arrangement according to the invention, the conductive layer 6, 7 can also be provided in the region of the welding zone 11 in such a way that the non-woven fabric arranged on the rear side of the seal is applied over the entire width of the sealing web 3 to be tested, but has only a low tensile bond strength compared to the sealing web 3 in the region of the welding zone 11, in such a way that it can be removed in the region of the welding zone after the tightness testing and before the welding, without great expense, and can subsequently be brought out of the welding zone 11 by being folded or cut back. The folding of the conductive layers 6 and 7, respectively, is shown by arrows in FIG. 5.

In a further embodiment of the structural seal or test arrangement according to the invention, the conductivity of at least one of the conductive layers 6, 7, preferably the conductive layer 7 arranged inside the seal 3 to be tested or arranged on the accessible, visible side of the seal 3, is set in such a way that even when the maximum possible test voltage and full electrical charge are applied to the seal in the case of a short circuit between the conductive layers 6, 7, the maximum possible short-circuit or discharge current through the conductive layer 7 which thus determines the internal resistance of the charged seal 3 is sufficiently limited that there is no risk to the test device 5 itself or health and safety risk, irrespective of at what point in the seal foreign objects or people come into contact with or into the vicinity of the seal which is under the test voltage. For this purpose, this conductive layer 7 or both conductive layers 6, 7 preferably have a surface resistance greater than $10^4$ ohm and a resistivity greater than $10^3$ ohm cm. In particular, a preferred embodiment of the structural seal according to the invention provides that an electrically non-conductive film or protective layer 12 is arranged on the visible side of the internal conductive layer 7 and is preferably of a light colour.

In a further embodiment of the structural seal or test arrangement according to the invention, at least one of the necessary electrically conductive layers 6, 7 is in the form of a metal film or metallised plastics material film or other metallic or metallised planar formation, at least one surface being electrically non-conductive. Preferably, a plastics material film is used which is metallised or is made conductive by adding conductivity-increasing substances or is conductive owing to the use of intrinsically conductive plastics materials, and which is arranged on the seal 3 to be tested in such a way that the electrically non-conductive side thereof is located on the side facing away from the seal 3, in such a way that upon contacting the surface of the seal 3 equipped in this manner there is no electrical contact with the test voltage as long as the edges of the conductive layer 7 are cleanly insulated at the edges of the test portion and the non-conductive rear side of the conductive layer 7 is not damaged. If the electrical resistance is measured between the conductive layer 7 formed in this manner and a steel reinforcement, for example a tunnel inner shell 4, laid after the manufacture of the seal 3, then according to the invention it can be established whether the reinforcement lies against the seal 3 in such a way that the seal has already been damaged on the upper side, albeit without having been pierced, it being possible to localise the position of the damage in the manner described above by measuring the line currents or the resistance ratios or the voltage ratios when measuring using at least two spaced supply lines or at least two spaced measuring points in one of the conductive layers 6, 7, in such a way that the risk point can still be detected and eliminated before concreting.

In a further embodiment of the structural seal or test arrangement according to the invention, one of the conductive layers is formed so as to be rigidly connected to the seal 3 to be tested, the conductive layer on at least one longitudinal side of the sealing web 3 to be tested not being guided up to the end thereof, but instead being at a sufficient distance therefrom, so that it is possible to weld the sealing web 3 to the neighbouring web 3 without the conductive layer extending into the joining zone 11.

In a further embodiment of the structural seal or test arrangement according to the invention, at least one of the conductive layers 6, 7 is formed so as to extend up to the edge of the webs which are to be connected and thus into the joining zone, remaining in the joining zone 11 during the connection process and mixing during the joining process with the material of the seal 3, which is plasticised by the joining, in such a way that the conductivity of the layer 6, 7 is interrupted in the joining region.

In a further embodiment of the structural seal or test arrangement according to the invention, at least one conductive layer 6, 7 is in the form of a removable film-type layer on the seal 3 to be tested, in such a way that the layer can at least be partially removed from the seal 3 again, if this is necessary for joining individual sealing webs 3.

In a further embodiment of the method according to the invention, the above-described conductive layer is also used to check, during the concreting process, whether the annular space to be concreted when concreting a tunnel inner shell, for example, is completely filled with concrete or whether there are unfilled regions in which the tunnel seal will be pressed unprotected onto the reinforcement of the inner shell upon subsequent loading with compressed water. For this purpose, according to the invention the electrical capacitance of one or both conductive layers, which must not have any electrical contact with the structure of the building or the concrete used, is measured during or after concreting against the concrete used, and the measured values are compared with a target value or a comparison value.

Implementation or application of the invention is not restricted to tunnels. Rather, the method according to the invention or structural seal according to the invention may also advantageously be applied when checking the tightness of seals for landfills, liquid reservoirs and/or roofs, in particular flat roofs.

The invention claimed is:

1. A method for detecting at least one of damaged points, faulty points, and weak points having a reduced material thickness in a membrane-type, electrically non-conductive or poorly conductive structural seal having a high electrical disruptive strength by comparison with air and that is provided with a first electrically conductive layer, the first electrically conductive layer being arranged inside or outside the structural seal and extending over substantially the entire surface of the structural seal and to which an electrical test voltage is applied, the method comprising:

providing a second electrically conductive layer, which is electrically separated from the first electrically conductive layer by the structural seal and extends over substantially the entire surface of the structural seal;

selecting a level of the electrical test voltage between the electrically conductive layers in such a way that, if there exists at least one of a damaged point, faulty point and weak point in the structural seal, an electrical disruptive strength is exceeded and an electric spark or arc is formed at the location of at least one of the damaged point, the faulty point and the weak point; and applying the electrical test voltage between the electrically conductive layers, wherein the electrical test voltage is selected to be smaller than a destructive test voltage at which an electrical breakdown accompanied by the formation of an electric spark or arc would occur in at least one of an undamaged structural seal and an un-weakened structural seal corresponding to the structural seal to be tested.

2. The method according to claim 1, wherein the electrical test voltage applied to the electrically conductive layers is selected to be at least 1000 volts per millimeter thickness of the structural seal to be tested.

3. The method according to claim 1, wherein an appearance of at least one of ignition sparks and electric arcs when the electrical test voltage is applied to the conductive layers is detected by detecting electromagnetic interference signals proceeding from at least one of the ignition spark and electric arc using at least one of a detector and by detecting and evaluating at least one of the light, thermal radiation, material heating effects proceeding from at least one of the ignition spark and electric arc, or any combination thereof.

4. The method according to claim 1, wherein at least one of the level of the test voltage applied via the conductive layers to the structural seal to be tested and the flow of current from a voltage source into one of the conductive layers is measured.

5. The method according to claim 1, wherein the structural seal to be tested is subdivided into individual test portions, in that at least one of the conductive layers is segmented in such a way that, when the test voltage is applied to the respective segment of the conductive layer, a charging with voltage is restricted to the associated test portion.

6. The method according to claim 1, wherein an electrically conductive abutment layer of the structural seal is used as one of the electrically conductive layers.

7. The method according to claim 1, wherein at least the second electrically conductive layer arranged on an accessible side of the structural seal is provided with an electrically non-conductive layer.

8. The method according to claim 7, wherein the electrically non-conductive layer is a light-coloured plastics material film.

9. The method according to claim 1, further comprising:

testing, using electrical capacitance measurement, whether the second electrically conductive layer arranged at least on an accessible side of the structural seal is formed over the entire surface and whether the first electrically conductive layer arranged on the rear side of the structural seal is formed over the entire surface.

10. A membrane-type structural seal, which is made of electrically non-conductive or only poorly conductive material and has a high electrical disruptive strength by comparison with air, comprising:

a test device for detecting at least one of damaged points, faulty points, and weak points having a reduced material thickness in the structural seal, and comprising:

an electrical voltage source;

a first electrically conductive layer which is arranged inside or outside the structural seal and extends over substantially the entire surface of the structural seal;

a second electrically conductive layer, which is electrically separated from the first electrically conductive layer by the structural seal and extends over substantially the entire surface of the structural seal;

means for setting the level of voltage which can be applied to the structural seal via the electrically conductive layers in such a way that a test voltage can be increased at least one of continuously and in steps from zero or a minimum value greater than zero to an electrical voltage which is reduced by a precautionary amount below a destructive voltage at which an electrical breakdown accompanied by formation of an electric spark or arc would occur in at least one of an undamaged structural seal and an un-weakened structural seal corresponding to the structural seal to be tested.

11. The structural seal according to claim 10, wherein the test device comprises a detector for detecting ignition sparks or electric arcs, and wherein the detector is formed from at least one camera.

12. The structural seal according to claim 10, wherein the structural seal is subdivided into individual test portions by segmentation of at least one of the electrically conductive layers.

13. The structural seal according to claim 10, wherein the electrically conductive layers and the structural seal are constructed as a preformed multilayer sandwich system, the electrically conductive layers being at least one of materially and positively connected to the structural seal, thereby separating them electrically.

14. The structural seal according to claim 10, wherein the electrically conductive layers have at least one of an electrical surface resistance of less than $10^6$ ohm and an electrical resistivity of less than $10^5$ ohm/cm.

15. The structural seal according to claim 10, wherein at least one of the electrically conductive layers is formed from a non-woven fabric, knitted fabric or another planar formation which is manufactured from non-conductive material, the non-woven fabric or planar formation being provided with a hygroscopic substance.

16. The structural seal according to claim 10, wherein at least one of the electrically conductive layers is arranged inside a plastics material sealing web from which the structural seal is formed, the electrically conductive layer being smaller overall than the plastics material sealing web, in such a way that the electrically conductive layer is completely enclosed by electrically insulating sealing material at the longitudinal sides of the plastics material sealing web.

17. The structural seal according to claim 10, wherein the structural seal is formed from plastics material sealing webs which can be welded together, one of the electrically conductive layers being connected to a rear side of the respective plastics material sealing web and the electrically conductive layer which is arranged on the rear side ending flush or virtually flush with one longitudinal edge of the plastics material sealing web and ending offset from another longitudinal edge by a width defining a rear joining edge, wherein the rear joining edge is equipped with an easily removable electrically conductive edge layer which is electrically connected to the conductive layer arranged on the rear side.

18. The structural seal according to claim 10, wherein the surface conductivity of at least one of the electrically conductive layers is set in such a way that even when a maximum possible test voltage and full electrical charge of the structural seal are applied in a case of a short circuit between the electrically conductive layers the maximum possible short-circuit or discharge current is limited to a non-life-threatening level.

19. The structural seal according to claim 18, wherein at least one of the electrically conductive layers have a surface resistance greater than $10^4$ ohm and an electric resistivity greater than $10^3$ ohm/cm.

20. The structural seal according to claim 10, wherein at least one of the electrically conductive layers is formed from a metal film, a metallised plastics material film, a plastics material film made electrically conductive by adding conductivity-increasing substances, an electrically conductive plastics material film made of intrinsically conductive plastics materials, a metal planar formation, a metallised planar formation, or any combination thereof, a side thereof facing away from the structural seal being formed so as to be at least one of electrically non-conductive and provided with an electrically non-conductive layer.

* * * * *

UNITED STATES PATENT AND TRADEMARK OFFICE

CERTIFICATE OF CORRECTION

PATENT NO. : 8,604,799 B2
APPLICATION NO. : 13/054852
DATED : December 10, 2013
INVENTOR(S) : Rödel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 512 days.

Signed and Sealed this
Twenty-second Day of September, 2015

Michelle K. Lee

Michelle K. Lee
*Director of the United States Patent and Trademark Office*